United States Patent [19]

Potts

[11] 4,448,266

[45] May 15, 1984

[54] DEEP WATER RISER SYSTEM FOR OFFSHORE DRILLING

[76] Inventor: Harold L. Potts, 2201 - 1081 Ambleside Dr., Ottawa, Ontario, Canada, K2B 8C8

[21] Appl. No.: 206,948

[22] Filed: Nov. 14, 1980

[51] Int. Cl.[3] ..... E21B 7/128

[52] U.S. Cl. ..... 175/7; 405/224; 166/367

[58] Field of Search ..... 175/7; 405/202, 205, 405/224, 195; 166/359, 367; 441/29

[56] References Cited

U.S. PATENT DOCUMENTS

| | | | |
|---|---|---|---|
| 3,181,182 | 5/1965 | Delavuelle et al. | 441/29 |
| 3,189,922 | 6/1965 | Margot et al. | 441/29 |
| 3,572,041 | 3/1971 | Graaf | 405/205 |
| 3,605,668 | 9/1971 | Morgan | 175/7 |
| 4,031,919 | 6/1977 | Ortloff et al. | 405/224 |
| 4,047,579 | 9/1977 | Wilckens | 175/7 |
| 4,170,266 | 10/1979 | Fayren | 175/7 |
| 4,216,834 | 8/1980 | Wardlaw | 175/7 |

*Primary Examiner*—William F. Pate, III

*Attorney, Agent, or Firm*—Michael M. Sakovich

[57] ABSTRACT

A buoyant riser system for use in a deep water offshore drilling environment is anchored by a system of compliant guys below the active weather zone of the sea. A controllably buoyant housing of the system is submerged at a depth that is readily accessible to divers and includes a blow-out preventer (BOP) from which a suspended sub-riser leads to a well bore to which the sub-riser is coupled. Above the housing, a riser suspended from a floating drill rig is coupled to the BOP thereby communicating the drill rig directly with the well bore for drilling and well completion operations.

20 Claims, 8 Drawing Figures

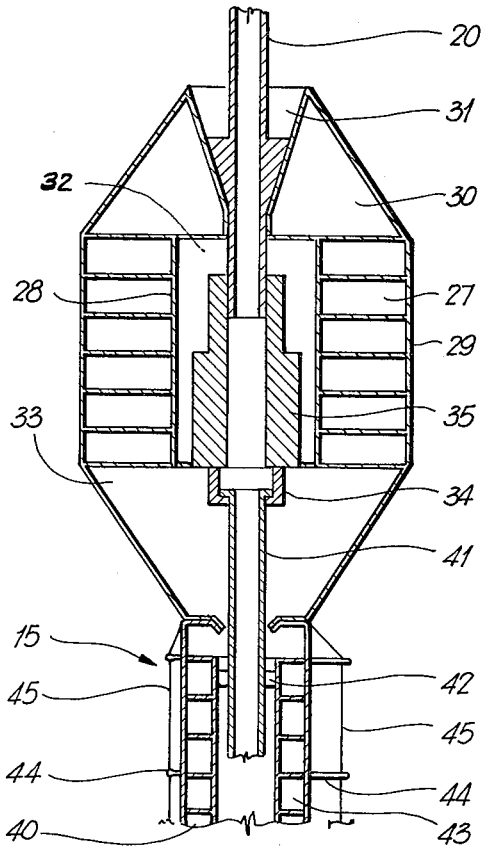
FIG. 2.
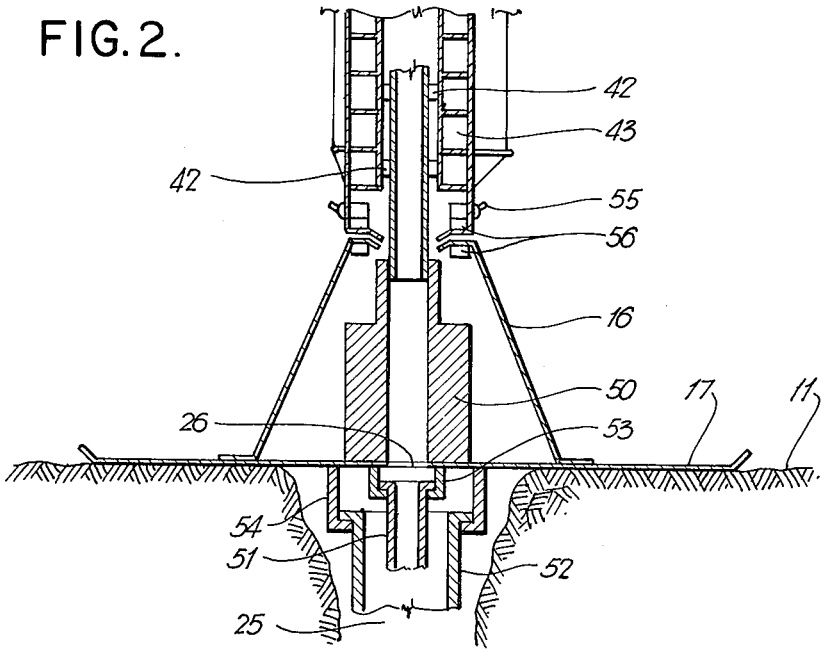

DEEP WATER RISER SYSTEM FOR OFFSHORE DRILLING

BACKGROUND OF THE INVENTION

The present invention relates to riser apparatus used in offshore drilling applications and more particularly to riser apparatus that is specially adapted for use in deep water.

A continuing search for new sources of fossil fuels has expanded outwardly from continental land masses and their bounding shallow-water shelves out to the open sea. Understandably, a plethora of problems arise to thwart and further complicate the best laid plans that high technology can develop in the quest for deep sea oil reserves.

Not the least of these problems is due to the vagaries of nature as they relate to climatic conditions. Often there is an open period suitable for drilling followed by a period of bad weather conditions during which well drilling operations must be suspended. Depending upon the severity and duration of the weather, a suspended well may be left unattended for the duration of the season. Not only does this result in a substantial loss of revenue but, in addition, additional finances must be provided to cover the extra costs involved in suspending and resuming well drilling.

At current rates, the cost of maintaining a drillship on site runs in the order of $300,000 per day. Taking into account travel time as well as the time necessary for preparing and abandoning a drill site, the cost of an untoward delay of three days would involve a sum in excess of $1,000,000.

Another problem that is particularly troublesome in deep sea operations is the difficulty of keeping the well overbalanced as the water depth increases. For example, assuming that a well is in a comfortable position of 100 psi overbalance, should it become necessary to move off location a reduction in hydrostatic head will occur when the riser is disconnected from the well. The magnitude of the reduction will depend on the mud weight and the water depth, and will amount to the difference between the density of the mud in use and the density of sea water, multiplied by the length of riser in use. In the case of a 3000 ft. riser using 12 lbs./gal. mud, the reduction in hydrostatic head would be more than 100 psi, taking the well from a condition of 100 psi overbalance to a condition of at least 400 psi underbalance. Precautions can of course be followed to avoid losing control of the well, as by controlling the rate of penetration, accurately controlling mud weight, circulating and conditioning the mud, to name but a few. However, these precautions are observed mainly during such times when there is an anticipation of pressure zones and/or during times of bad weather which may require a well disconnect to ensure the safety of personnel.

Numerous other problems occur, all of which are depth related which adversely affect personnel safety and extend drillship operating times. For instance, the difficulties of re-entry are directly proportional to the depth of the re-entry point. The advantages of a re-entry operation in shallow water offering diver access are thus readily apparent. Furthermore, equipment simply cannot be maintained by divers at depth and serious malfunctions can lead to pulling the riser or even abandoning the well in extreme cases.

One answer to the problem of equipment maintenance is to substitute sophisticated remote controls. This, however, in an expensive alternative and is frequently inadequate to deal with the myriad of problems that may occur on site that only the human intellect and manual dexterity may solve.

The operational zones below the surface of the sea may be categorized by depth. Thus, the top 50 meters of the sea can be considered as the weather zone which can be subdivided into a splash zone (above) and a wave zone which includes the splash zone.

The top 100 meters is readily accessible to divers although diving operations are limited in the zone between 100 and 500 meters. Operations beyond 500 meters are infrequent and, for most practical purposes, not feasible.

Beyond the 500 meter depth, it is no longer feasible to use conventional hydraulic lines for actuating blow-out preventer (BOP) controls, and, as a result, resort must be made to electro-hydraulic relaying.

The problem of significant loss of hydraulic head of a riser disconnected in deep water has been noted. Assuming that a 12 lb. mud is maintaining a 100 psi overbalance, this overbalance can be lost if the water depth is greater than 170 meters. Improved well safety by keeping the BOP within 200 meters of the surface will ensure only moderate mud head loss and permits maintenance by divers if needed. This however is merely a re-statement that it is preferable to conduct drilling operations in shallow water since heretofore it was considered incongruous to associate an elevated BOP with a deep sea drill site at which the conventional position of the BOP is on the sea bed.

SUMMARY OF THE INVENTION

One provision of the present invention is a deep water riser system in which the BOP is brought closer to the surface; in fact into diver range so as to significantly improve the economics of off-shore operations and reduce the risk of equipment failure.

Another provision of the invention is a practical buoyancy system for risers.

Still another provision of the invention is apparatus for reducing a need for applied tension in risers and to allow operations in deep waters using existing drill rigs.

Yet another provison of the invention is riser apparatus that is stiffened to increase its resistance to buckling.

Another provision of the invention includes a stabilized system of guying means which limits the degree of lateral motion of the top end of the riser apparatus and which produces a restoring force to return the top end to a stable position when it is displaced laterally therefrom.

Yet another provision of the invention includes a system of compliant guys having the form of a special catenoid profile.

Another provision of the invention is a variable buoyancy chain link useful in combination with conventional guys to form the special profile catenoid.

The problems associated with the prior art may be substantially overcome and the foregoing objectives achieved by recourse to my invention which is a deep water riser system for offshore drilling and well completion. The system comprises, in combination, buoyancy means adapted to be anchored at a predetermined depth in support of a submerged load, riser coupling means including closure means having an inlet and outlet attached to the buoyancy means, sub-riser means connected to the inlet and depending from the buoyancy means for communicating the coupling means with a well bore, and riser means connected to the outlet for communicating the well bore with a floating drill rig positioned thereabove.

DESCRIPTION OF THE DRAWINGS

The invention will now be more particularly described with reference to embodiments thereof shown, by way of example, in the accompanying drawings in which:

FIG. 2 is a sectional view taken along the lines 2—2 of a portion of the system shown in FIG. 1;

DESCRIPTION OF THE ILLUSTRATED EMBODIMENTS

Figure 1:
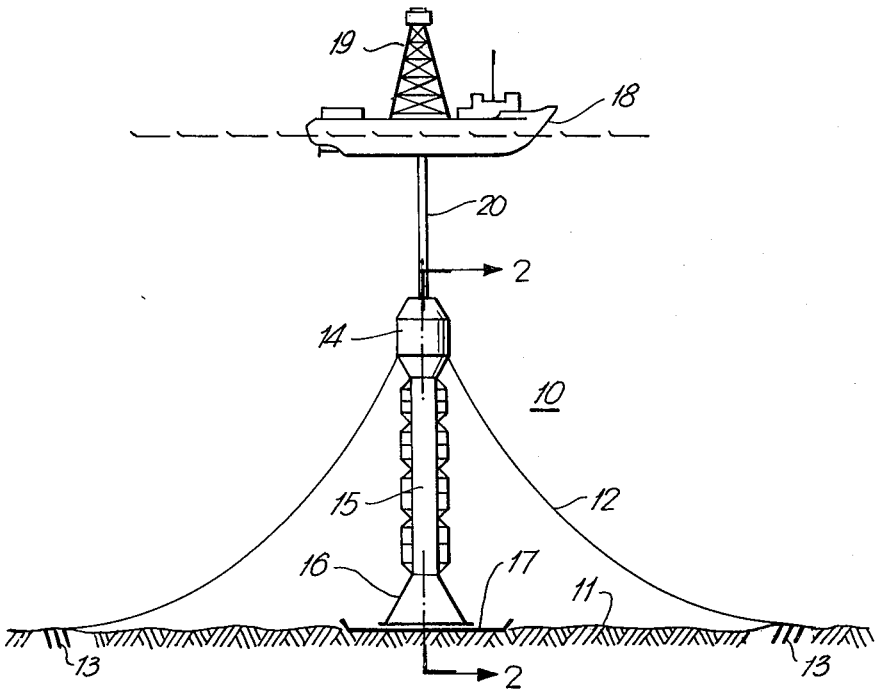
FIG. 1 is a side elevation view of a deep water riser system in accordance with the present invention.

FIG. 1 illustrates diagrammatically a side elevation view of a deep water riser system 10 for offshore drilling, the system being securably anchored to the sea bed by guying means having at least three equally spaced guy cables 12 of which only two are shown. The lowermost end of each cable 12 is anchored to the sea bed by means of anchors 13 whereas the uppermost ends of the cables are connected to a buoyant body shown as a housing 14. A sub-riser assembly 15 is suspended vertically from the housing 14, being held against an upper portion of a bridge 16 in pivotal relation with a well bore, not shown, in the sea bed 11. A bed plate 17 provides a supporting platform for the system 10.

The present practice in drilling a deep offshore well is to employ a dynamically positioned drillship 18 or some similar floating drill rig or semi-submersible positioned above the drill site. Thus, the drillship 18 functions as a floating platform from which are performed all tasks necessary in deploying sub-sea equipment. According to the embodiment illustrated in FIG. 1, it will be understood by those skilled in the art that on arriving at the site the drillship 18 will enable its rig 19 as required to drill and set surface casing in the first 100 meters of any hole drilled, set the bridge 16 and the plate 17 as required, set the assembly 15 and housing 14 and run a marine riser 20 to the rig 19.

The time required for deployment of the sub-sea equipment 14, 15, 16, 17 identified hereinabove and the riser 20 will depend on a number of different factors, some predictable and some occurring at random. Typically, for a well in one-thousand meters of water, such deployment would seldom be accomplished in under one week. According to the maintenance costs previously described, one week's rig time would thus require an expenditure in excess of $2,000,000.

In accordance with the objectives of the embodiments of the invention herein to be described, in order to minimize expensive drill rig time, the system 10 has been adapted for use with conventional boats or barges, or special purpose craft to tow the housing 14 and the assembly 15 and to set same in place in advance of the arrival of the drillship 18.

The upper depth limit for setting the system 10 is about 50 meters since this would keep the system below weather and wave effects and well below the keels of floating craft, a fact that is economically important since the system is intended to be left intact throughout the productive life of the well.

A more detailed diagrammatic sectional view of the housing 14 and assembly 15 is illustrated in FIG. 2 which, it will be noted, also shows a well bore 25 coaxially positioned with a central aperture 26 of the plate 17.

Reference to the housing 14 shows inner and outer sidewalls 28 and 29, respectively, which define an annular closed chamber that comprises a plurality of stacked toroidal ballast tanks 27. A nose cone portion 30 includes a recessed entry cone 31 which is normally covered over to facilitate towing the housing 14 and the assembly 15 to the drill site. In its functional state, as illustrated, the cone 31 is uncovered to accept the free end of the riser 20 which enters and is coaxially aligned with an aperture 32 that is defined by the sidewall 28.

A tail-cone portion 33 is adapted to engage the upstanding end of the assembly 15 and operates as a spacer to separate a hanger 34 from the assembly 15.

Contained coaxially within the aperture 32 is a blowout preventer (BOP) stack that, together with the cone 31, aperture 32 and hanger 34, acts as a riser coupling means including closure means for communicating the riser 20 with the assembly 15.

The trailing end of the portion 33 is flanged and is adapted to mate with a corresponding portion of the uppermost end of the assembly 15 which comprises a tube 40 that encloses a sub-riser 41 which is disposed coaxially within the tube and is held in position by means of sub-riser supports 42.

Additional bouyancy for the system 10 is provided by a plurality of toroidal ballast tanks 43 which are disposed at opposite ends of the tube 40 in coaxial alignment with the sub-riser 41.

Although not indicated in the drawings, it will be understood by those skilled in the art that the system 10 has a requirement for and is to be provided with a fail-safe capability. This means that apparatus known in the art is provided for automatically flooding the ballast tanks to overcome a positive buoyancy in the event that either one or both the housing 14 and tube 40 break free of their respective sea bottom restraints. It is self-evident that is a positively buoyant assembly 15 ever came adrift of the housing 14, it would become a very effective torpedo coming directly up at the drillship 18. Thus, the buoyancy must be cancelled before the loose part has time to rise up and do serious damage.

As a further safeguard, some of the newer plastic materials would be a better choice of material for constructing the housing 14 and the tanks 27 and 43 of the assembly 15 since, although their impact resistance is high, they are highly compliant and would therefore not inflict such high loads during impact with a ship as would most metals.

Economic concerns similarly apply and it would be equally as obvious to those skilled in the art that expensive pieces of equipment should not be summarily jettisoned to the sea bottom where it would be difficult or even impossible to recover. In this regard, although not illustrated, it will be understood that both the housing 14 and the assembly 15 are provided with marker buoys, not shown, which release in response to a respective loss of positive buoyancy in the housing and assembly. In this way, location of a jettisoned piece of equipment is marked to facilitate later retrieval.

Overall, the length of an assembly 15 may be of the order of 1,000 meters, and, under varying conditions of stresses imposed on the assembly such as by compression loads, much flexing, buckling and rotational bending in the assembly 15 occur. Some difficulty will therefore be experienced in pulling a drill string through the sub-riser 41 under these conditions, particularly at the discontinuity formed by a flexed, buckled or pivoted assembly 15 at its union with the bore 25.

Figure 7:
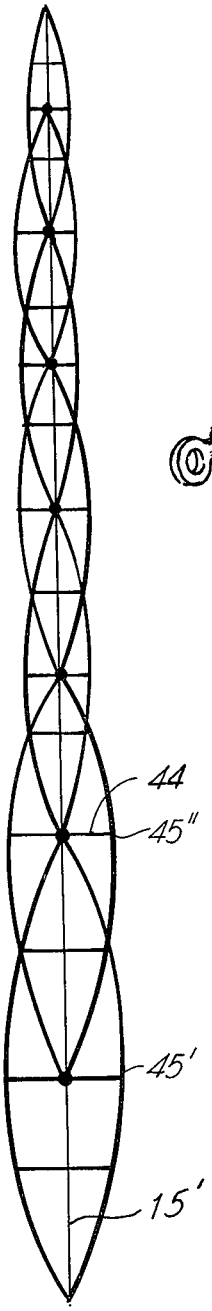
FIG. 7 is a diagram illustrating an arrangement of stringers on the apparatus of FIG. 1.
Figure 8:
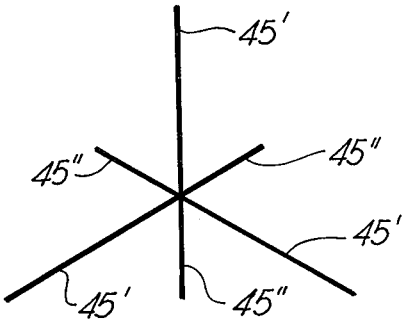
FIG. 8 is a plan view of FIG. 7 showing a radial interlaced distribution of the stringers of FIG. 7.

The foregoing difficulty is substantially resolved by means of stiffening the tube 40 using a combination of struts 44 and stringers 45 as illustrated diagrammatically in FIGS. 7 and 8. It will be observed therein, and understood, that the stringers 45 are supported longitudinally along and outstanding from the outer periphery of the tube 40 in the arrangement herein to be described for stiffening the tube and resisting a tendency of the tube to buckle and rotationally deflect under compressive loads. According to FIG. 7 the struts and stringers are disposed in three equidistant rows along the tube in a primary tapered series of stringers 45' which describe a sine function. In addition and interlaced with the stringers 45' as best illustrated in FIG. 8, there are three equidistant rows along the tube 40 of stringers 45" arranged in a secondary tapered series describing a cosine function. The interlaced combination of the stringers 45' and 45" show, in FIG. 7, that the anti-node of one stringer coincides with the node of the other.

As a result of the aforedescribed stiffened tube 40, it is possible to suspend the sub-riser 41 inside the tube so that the sub-riser can be isolated from external loads and can, if desired, be kept in tension due to its own weight alone. This is an important consideration in the case where wear and tear of the sub-riser 41 necessitates replacement. As a result, replacement may be performed in the conventional manner without replacing the entire assembly 15 or even the stiffening structure, at best an extremely difficult task to perform at the site.

An auxiliary BOP stack 50 is mounted on the plate 17 in coaxial alignment with the aperture 26 as well as the sub-riser 41. Depending from the hanger 34, the sub-riser 41 extends outwardly of the tube 40 at its lowermost end and is secured by means of a connector portion of the stack 50. A similar arrangement is provided in the housing 14 with the free end of the riser 20 which is likewise secured by a corresponding connector portion of the stack 35. Alignment of the system 10 with the bore 25 is illustrated in FIG. 2 which shows an intermediate casing 51 and a concentric conductor casing 42 suspended from corresponding hangers 53 and 54. The combination described thus provides means for communicating the bore 25 with the drillship 18 positioned thereabove.

While only diagrammatically illustrated, it will be understood by those skilled in the art that a peripheral arrangement of maneuvering jets 55 may be used effectively in combination with closed-circuit television cameras, not shown, or with transponders 56 in order to direct accurate docking of the tube 40 with the bridge 16.

In the guying arrangement of FIG. 1, each cable 12 exerts a vertical and horizontal load on the tube 40. Since the radial arrangement of cable 12 is symmetrical, the horizontal loads cancel leaving only the vertical load. However, in the event that the tube 40 is rotated or pivoted under the action of an applied horizontal force, a horizontal returning force is produced to restore equilibrium upon cessation of the applied horizontal force as is known in the art. In the static equilibrium state, therefore, the cables 12 assume an ordinary catenary form.

Figure 3:
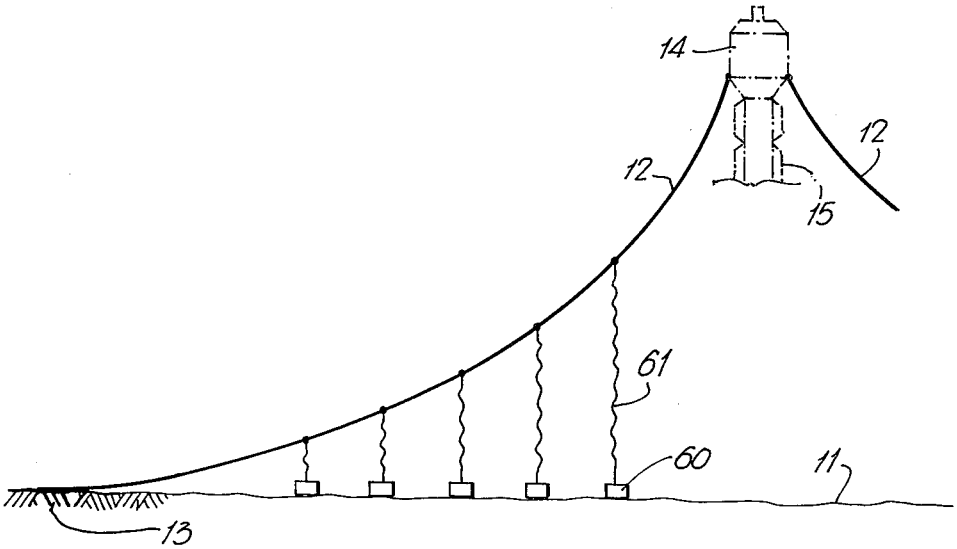
FIG. 3 is a partial view of FIG. 1 showing, in addition, stabilizing apparatus connected to a system of guys shown in FIG. 1.
Figure 4:
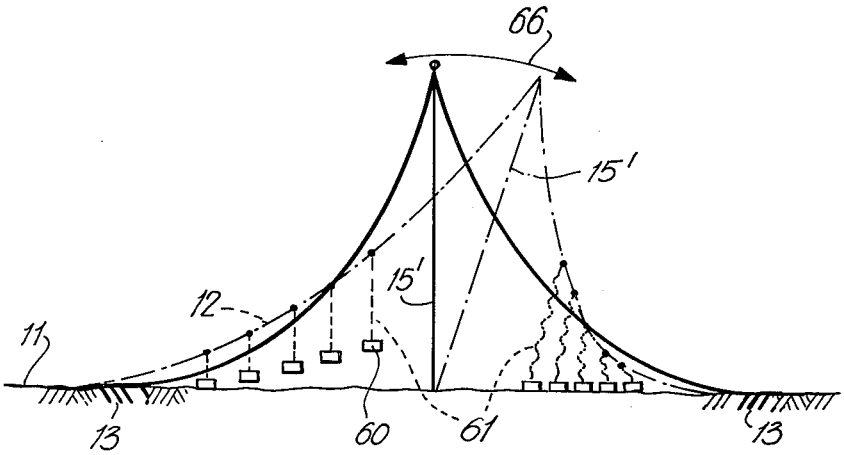
FIG. 4 is a diagram illustrating the method by which the apparatus of FIG. 3 functions.

FIG. 3 illustrates a portion of FIG. 1 with the addition of stabilizing means connected to the cables 12 for controllably limiting the degree of lateral motion of the housing 14 and pivotal motion of the assembly 15. Such means take the form of a plurality of clump weights 60 connected by lines 61 to the cables 12. It will be understood that the weights 60 are distributed uniformly on the sea bed under each cable 12 with individual ones of the weights being connected by its line 61 which is proportioned in length such that successive ones of the weights are lifted and produce a restoring force as the assembly 15 is pivoted away from the anchored end of a cable 12. A dynamic illustration of the manner in which the weights 60 function is schematically illustrated in FIG. 4. For purposes of simplicity, the assembly 15 is depicted merely by its long axis 15'. Moreover, the weights 60 and their respective lines 61 have been omitted in the figure indicating an equilibrium condition in which the axis 15' is perpendicular to the sea bed 11.

A condition in which the axis 15' is tilted to the right-hand side is illustrated in FIG. 4 in broken line form. Arrows 66 indicate the direction taken by the axis 15' when its equilibrium position is disturbed and the returning direction as equilibrium is restored by the combined action of the cables 12 and the weights 60. A comparison of the equilibrium and non-equilibrium states illustrated in FIG. 4 shows that on the left-hand side successive ones of the weight 60 are lifted and produce a restoring force as the axis 15' is pivoted away from the anchored end of the cable 12. Concurrently, the lines 61 on the right-hand side tend to collapse as the axis 15' leans in that direction.

It is known in the art that the ordinary catenary is the form assumed by a hanging chain having infinitely small links which are all of equal weight. If the links are not all of equal weight, the hanging form will depend only upon the magnitude and distribution of each of the separate non-equal lengths. Conversely, any desired continuous curve form may be duplicated in the hanging form by suitably distributing lengths of predetermined weight.

Figure 5:
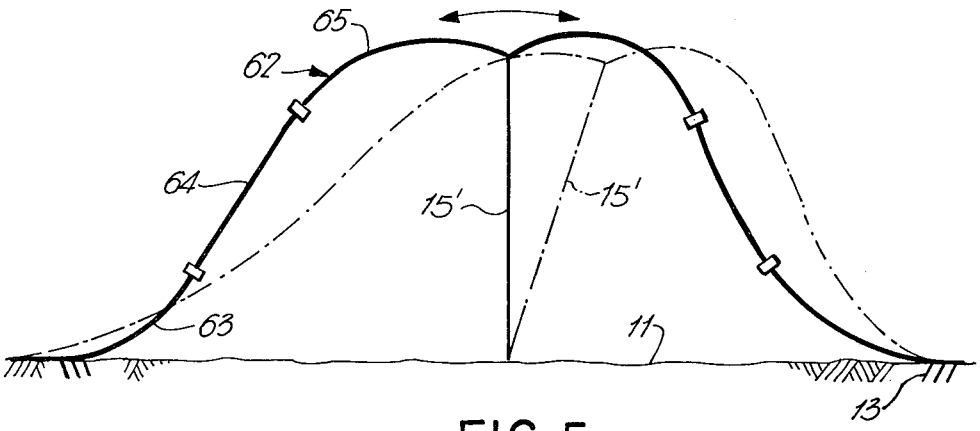
FIG. 5 is a diagram illustrating a pair of special profile catenoid guys and the manner in which such guys function.

In any fluid medium a body may be fabricated that will exert an upthrust greater than its weight in vacuo. It is therefore possible to have a catenoid form with both convex, straight and concave portions as illustrated in FIG. 5 which is a schematic presentation of a special profile guying system. For purposes of simplicity, only two guying cables 62 are shown although it will be understood that a minimum of three cables are required to effect an equilibrium condition for the axis 15'.

Each cable 62 is divided into three portions. One portion 63 comprises a negatively buoyant section, an intermediate portion 64 is neutrally buoyant and an upper end portion is positively buoyant as is apparent in the drawing. In the equilibrium state, shown in solid line form in FIG. 5, the portion 63 will configure itself such that its unsupported underwater weight will be equal to the total upthrust of the portion 65 less any net vertical force exerted on the axis 15'. Thus, the net effect of all cables 62 on the axis 15' will be to exert an upward force and a zero horizontal force as indicated.

Should the axis 15' now be displaced to the right-hand side as indicated by the broken line portion of FIG. 5, due to the action of an external horizontal force, the left-hand cable 62 will move so as to decrease the value of the vertical force on the axis 15'. Concurrently, the right-hand cable 62 will move to a new position so as to increase its applied tensile load on the axis 15', although not substantially, and will be displaced to the right with a reduced horizontal component of force. The final deflected position of the cables 62 and the axis 15' may be seen in the broken line portion of FIG. 5.

Employment of the foregong special underwater guying system serves to limit compressive vertical loads on the assembly 15 while at the same time ensuring an adequate restoring force in the horizontal direction thereby providing stability for the system 10 under conditions of equilibrium disturbing horizontal force perturbations.

Use of a buoyant section in a guying system as described permits a tensile load to be applied to the housing 14 and therefrom to the assembly 15. Thus, some part of the tube 40 at its upper end will be in tension. Depending upon the magnitude of the axial component of the applied load, and upon the distribution of weight within the assembly 15, there will be a lessening of the magnitude of the tensile axial loading in the tube 40 at points further and further from the point of application of the guying system. In general, there will be a lessening to zero at some point beyond which at the lower end the tube 40 will be in compression. Thus, recourse to buoyant sections in a guying system can be used to beneficial effect by reducing compression loads on the tube 40 which will reduce rotary deflection of the tube indicated in FIG. 7. Accordingly, since the arrangement of stringers 45 in FIG. 7 results in deflection under compression which is greater at the top of the tube 40 than at the base thereof, a reduction in the compression load which will place the upper end of the tube 40 in tension will serve to substantially eliminate deflection in the assembly 15.

Figure 6:
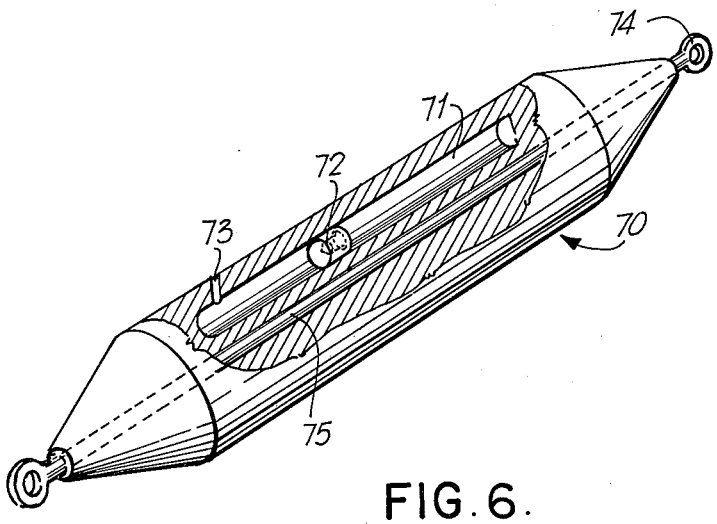
FIG. 6 is a perspective view of a variable buoyancy chain link with a portion broken away to show the inner structure thereof.

The buoyancy of any guying cable described herein may be altered to effect a special profile by adding to the cable a variable displacement link 70, a perspective view of which is shown in FIG. 6. The link comprises a buoyant mass that is coaxially disposed about a connecting rod 75 fabricated from steel or any other suitable material of sufficient strength and includes a longitudinal chamber 71 in which is contained a freely slidable piston 72. The chamber 71 on one side of the piston communicates with the environment by means of a vent 73 whereas that portion of the chamber on the other side of the piston remains closed and varies in volume inversely with pressure applied to the piston 72 from the environment. In this way variable buoyancy, including a neutrally buoyant condition, can be achieved depending upon the degree of flooding in the chamber 71. Solid connections with guying cables are made by means of eyelets 74 disposed at opposite ends of the link and the connecting rod 75 which passes through the link to interconnect the eyelets.

If the link 70 is used in adequate numbers in a guying system so as to increase its buoyancy in response to an upward vertical displacement, then this would cause the hanging form of the guy cables to elongate in the horizontal direction. In turn, this would cause a flatter curve, having less vertical load on the tube 40 for a given value of horizontal load.

Since the mass of air in the chamber 71 is constant, the volume of the air will change inversely in response to the pressure exerted by the water on the other side of the piston 72 as described. Thus, as the link 70 moves into shallower water, the reduced water pressure will result in an increase in the effective buoyancy of the link. Therefore, a plurality of links 70 would produce the characteristic sought which is a flattening of the hanging form in response to an increase in horizontal tension of a guying cable.

It will be apparent to those skilled in the art that the preceding descriptions and embodiments may be substantially varied to meet specialized requirements without departing from the spirit and scope of the invention. The embodiments disclosed are therefore not to be taken as limiting but rather as exemplary structures of the invention which is defined by the claims appended hereto.

What I claim is:

1. A deep water riser system for offshore drilling and well completion comprising, in combination:

buoyancy means adapted to be anchored at a predetermined depth in support of a submerged load;

riser coupling means including closure means having an inlet and an outlet attached to said buoyancy means;

sub-riser means connected to said inlet and depending from the buoyancy means for communicating said coupling means with a well bore;

riser means connected to said outlet for communicating the well bore with a floating drill rig positioned thereabove; and guying means including cable means having lengths of predetermined positive, neutral and negative buoyancy adapted to anchor said buoyancy means at a depth established by the sub-riser means and to stabilize said system by producing a restoring force for controllably limiting lateral excursions of said buoyancy means and corresponding pivotal motions of said sub-riser means.

2. A system as claimed in claim 1 wherein the sub-riser means comprises a tube enclosing a sub-riser disposed coaxially therewithin, and a plurality of toroidal ballast tanks disposed at opposite ends of the tube in coaxial alignment with said sub-riser.

3. A system as claimed in claim 2, further comprising:

bridge means disposed on the sea bed for securing said sub-riser means in pivotal relation with the well bore, said bridge means including a bed plate having a central aperture coaxially positioned with the well bore.

4. A system as claimed in claim 3 wherein said buoyancy means comprises a housing having inner and outer sidewalls defining an annular closed chamber.

5. A system as claimed in claim 4 wherein the closed chamber is divided into a plurality of toroidal ballast tanks.

6. A system as claimed in claim 5 wherein said riser coupling means comprises a blow-out preventer stack disposed coaxially with the aperture of the closed chamber.

7. A system as claimed in claim 6 wherein said stack includes connector means for mechanically securing the riser means thereto and hanger means for suspending the sub-riser means therefrom.

8. A system as claimed in claim 7 wherein all said toroidal ballast tanks are adapted to be selectively flooded and blown to control the buoyancy and attitude of the housing and tube.

9. A system as claimed in claim 8 further comprising means for automatically flooding the toroidal ballast tanks to overcome positive buoyancy in the event that at least one of the housing and tube break free of their respective sea bottom restraints.

10. A system as claimed in claim 9 further comprising a marker buoy attached to each of the housing and tube and releasable therefrom to locate same in response to a respective loss therein of positive buoyancy.

11. A system as claimed in claim 10 wherein said bridge means further includes an auxiliary blow-out preventer stack mounted on the bed plate in coaxial relation with the central aperture.

12. A system as claimed in claim 11 wherein the auxiliary blow-out preventer stack includes connector means for mechanically securing the free end of the sub-riser thereto and hanger means for suspending into the well bore an intermediate casing and a conductor casing disposed coaxially therewithin.

13. A system as claimed in claim 3 further comprising:

jet means mounted on said sub-riser means for submerged maneuvering thereof; and transponder means disposed on said sub-riser means and said bridge means for directing accurate docking therebetween.

14. A system as claimed in claim 2, further comprising pre-tensioned stringers supported longitudinally along and outstanding from the outer periphery of the tube in a predetermined arrangement for stiffening the tube and resisting a tendency of the tube to buckle and rotationally deflect under compressive loads.

15. A system as claimed in claim 14 wherein the stringers are supported by a plurality of struts upstanding from the outer periphery of the tube, said struts and stringers being disposed in three equidistant rows along the tube in a primary tapered series describing a sine function and in three interlaced equidistant rows along the tube in a secondary tapered series describing a cosine function.

16. A system as claimed in claim 14 wherein said cable means comprises at least three guying cables disposed uniformly around the housing and the tube depending therefrom, each cable having one end attached to one of the housing and adjacent tube end, a free end disposed on the sea bed and an intermediate portion describing a catenoid form having convex, straight and concave portions.

17. A system as claimed in claim 16 wherein each guying cable comprises a lowermost portion that is negatively buoyant, an intermediate portion that is neutrally buoyant and an uppermost portion that is positively buoyant.

18. A system as claimed in claim 17 comprising a plurality of variable displacement links in said uppermost portion, said links having a variable buoyancy characteristic that is inversely proportional to water pressure.

19. A system as claimed in claim 18 wherein each one of said links comprises:

a connecting rod having an eyelet at each end for connection to said cable means;

a closed longitudinal chamber having side walls, embodying said rod;

a piston slidably disposed within said chamber and defining first and second subchambers inversely related in volume; and an aperture in the side wall of one subchamber permitting exposure of enviornmental pressure to said piston.

20. In a deep water riser system for offshore drilling and well completion comprising, in combination, buoyancy means adapted to be anchored at a predetermined depth in support of a submerged load, riser coupling means including closure means having an inlet and an outlet attached to said buoyancy means, sub-riser means connected to said inlet and depending from the buoyancy means for communicating said coupling means with a well bore, and riser means connected to said outlet for communicating the well bore with a floating drill rig positioned thereabove, an improvement comprising guying means including cable means having lengths of predetermined positive, neutral and negative buoyancy adapted to anchor said buoyancy means at a depth established by the sub-riser means and to stabilize said system by producing a restoring force for controllably limiting lateral excursions of said buoyancy means and corresponding pivotal motions of said sub-riser means.

* * * * *